US005584444A

United States Patent [19]

Farmer

[11] Patent Number: 5,584,444

[45] Date of Patent: Dec. 17, 1996

[54] DEVICE FOR REWINDING ELECTRIC FENCE WIRE

[75] Inventor: Jay D. Farmer, Rte. 2, Box 786, Mannford, Okla. 74044

[73] Assignee: Jay D. Farmer, Mannford, Okla.

[21] Appl. No.: 625,280

[22] Filed: Apr. 1, 1996

[51] Int. Cl.[6] ..... B65H 75/40

[52] U.S. Cl. ..... 242/395; 242/403; 242/406

[58] Field of Search ..... 242/395, 398, 242/403, 404, 406, 598, 598.5, 599.3, 599.4

[56] References Cited

U.S. PATENT DOCUMENTS

| | | | |
|---|---|---|---|
| 327,195 | 9/1885 | Roberts | 242/395 |
| 446,487 | 2/1891 | Vannatta | 242/395 |
| 498,307 | 5/1893 | Rule | 242/406 |
| 692,412 | 2/1902 | Austin et al. | 242/395 |
| 876,089 | 1/1908 | Phillips | 242/598.5 |
| 983,795 | 2/1911 | Youngren | 242/406 |
| 2,236,305 | 3/1941 | Ahlin | 242/406 |
| 2,890,005 | 6/1959 | Hoogestraat | 242/395 |
| 3,128,962 | 4/1964 | Bieber | 242/403 |
| 3,558,101 | 1/1971 | Ward | 242/406 |
| 3,650,492 | 3/1972 | Stum . | |
| 4,190,211 | 2/1980 | Janzen | 242/599.3 |
| 4,390,141 | 6/1983 | Webster | 242/403 |
| 5,056,732 | 10/1991 | Nicholson, Jr. | 242/395 |
| 5,186,410 | 2/1993 | Toews | 242/403 |

FOREIGN PATENT DOCUMENTS

| | | | |
|---|---|---|---|
| 927710 | 6/1963 | United Kingdom | 242/403 |

*Primary Examiner*—John P. Darling
*Attorney, Agent, or Firm*—Molly D. McKay, P.C.

[57] ABSTRACT

A device removably attachable to an electric wire spool to enable the rewinding of electric wire onto the spool in the field. The device is provided with a shaft insertable through central openings provided in the spool so that a longitudinal axis of the shaft is approximately horizontal. A bushing is provided on the shaft on either side of and adjacent to the spool so that a flange provided on each bushing abuts the spool. Each flange is provided with flange openings which can be aligned with pairs of aligned spool openings provided in the spool, and a spool fastener inserts through the aligned spool and flange openings to removably secure the spool to the bushings. Each bushing is provided with bushing openings which align with shaft holes provided in the shaft. Each pair of the bushing openings and their associated shaft hole align in a plane approximately perpendicular to the longitudinal axis of the shaft so that bushing fasteners can insert therethrough in order to removably secure the bushings to the shaft. Adjacent each bushing on either end of the shaft, the shaft rotatably extends through an eye of one of two support members. The support members secure the device in its holder in order to removably mount it either on a fence post or on a vehicle. One end of the shaft is provided with a handle for rotating the shaft and the attached spool.

9 Claims, 2 Drawing Sheets

DEVICE FOR REWINDING ELECTRIC FENCE WIRE

BACKGROUND OF THE INVENTION

1. Field of the Invention

The present invention relates to a device which can be used in conjunction with a spool on which electric fence wire is sold in order to rewind used wire onto the original spool. More specifically, the device removably secures to a spool in order to rotatably mount the spool so wire can be rewound thereon.

2. Description of the Related Art

Electric fences have been used for many years as barriers for retaining or excluding animals, usually domestic animals such as cattle, from certain parcels of property. These electric fences usually are comprised of a continuous length of electric wire which is mounted via electrical conductors to posts secured in the ground so that the wire encircles a parcel of property. The electric wire is connected to a low voltage power source, usually a battery, and a control box which periodically causes the wire to be energized with electrical current. When the electrical wire is so energized, any animal coming into contact with the energized wire will serve as a conduit to ground the wire and will thereby receive a painful, although not injurious, shock. Animals do not like to be shocked and will quickly learn to associate the wire with pain. After being shocked once or twice, the animal will avoid coming into contact with the wire. Thus, the energized wire becomes a barrier for the animals since they will not approach the energized wire once they learn that contact with it causes a shock. An electric fence can be installed much more quickly and at a much lower cost than a conventional fence, such as those employing barbed wire stretched between wooden or metal supporting posts. Also, electrical fences can be more easily, quickly and economically moved when circumstances warrant.

Intensive grazing is a type of grazing practice which is gaining widespread acceptance in the United States, particularly in the plains states. This practice involves frequent moving of large herds of cattle from one small parcel of property to another. The cattle eat the grass contained in the parcel down until there is no grass left and then the herd must be moved to a fresh parcel. The grass on the old parcel then has time to grow back again before the herd is reintroduced thereon. Rather than erect a series of traditional crossfences consisting of barbed wire so that intensive grazing can be practical, ranchers often prefer to employ more flexible means to retain the herd within a parcel. Electric fences are one preferred option.

One problem associated with use of electric fences is the need to occasionally move the fence. This entails rewinding the electric wire comprising the fence onto some type of spool, preferably the same type of spool that the wire was wound onto when it was originally purchased. Manually holding the spool and rewinding the wire onto the spool by hand is difficult for several reasons. First, as wire is wound onto the spool, the spool becomes progressively heavier and more difficult to hold in a person's hands. Second, with the hands occupied in holding the spool and winding the wire thereon, it is difficult to wind the wire smoothly and tightly around the spool. If the wire is not wound smoothly and tightly onto the spool, the spool will not be able to hold all of the length of wire which was originally contained on the spool. Also, if the wire is not rewound onto the spool in a smooth fashion, the wire can tangle and will be difficult to remove from the spool when needed to build another fence.

The present invention addresses these problems by providing a fully field assemblable and disassemblable device for rotatably holding an electric wire spool. The device can be mounted, via a holder, to a T-type metal post or alternately can be mounted onto a vehicle. The device is provided with a hand operated crank which allows the user to employ one hand to rotate the attached spool, leaving the other hand free to straighten, detangle and guide the wire smoothly and tightly onto the spool. When a spool is full, the full spool can be easily removed from the device and replaced with an empty spool so an additional length of wire can be rewound onto another empty spool.

SUMMARY OF THE INVENTION

The present invention is a device for rewinding electric fence wire onto a spool. The device is provided with a horizontal, rotatable shaft. A handle for rotating the shaft secures to a first end of the shaft and an opposite second end of the shaft extends consecutively through the following: a first eye provided on one end of a first support member, a first bushing, a pair of aligned central openings in the spool, a second bushing and a second eye provided on one end of a second support member.

Each bushing is provided with a pair of bushing openings which align with a shaft hole provided in the shaft so that each pair of bushing openings and their associated shaft hole align along a plane perpendicular to the longitudinal axis of the shaft. A bushing fastener extends through each pair of aligned bushing openings and associated shaft hole in order to secure the bushings to the shaft. If the bushing fastener is a bolt, it is secured to the device via a nut.

Each bushing is provided with a flange which abuts the spool. Each flange is provided with flange openings which align with the flange openings of the other flange along a plane parallel to the longitudinal axis of the shaft. The spool is provided with pairs of aligned spool openings which can be aligned with the flange openings of the two flanges. A spool fastener inserts through the aligned flange openings and their associated aligned pair of spool openings in order to secure the spool to the bushings. If the spool fasteners are bolts, then nuts are engagable with the spool fasteners to secure the spool fasteners to the device.

The device can be mounted in a variety of ways. The most common ways of mounting the device is to mount it either on a fence post or on a vehicle. If the device is mounted on a fence post, such as the T-type metal fence posts commonly used in many of modern day fences, it is generally advisable to employ a holder to mount the device thereto. A variety of different types of holders may be created for mounting the device to a pole, but one type employs a U-shaped horizontal frame with a central frame portion and legs extending horizontally outward from each end of the central portion. A hollow end pipe having a closed lower end and an open upper end is attached to the distal end of each leg. Each end pipe extends upward approximately perpendicular from its associated leg. The open upper ends of the end pipes removably receive second ends of the support members, or alternately, are removably received in open second ends of the support members in order to secure the device to the holder.

The frame is also provided with a hollow central pipe which attaches approximately perpendicularly to the central portion midway between the opposite ends of the central portion and extends upward therefrom. The central pipe has an upper closed end and a lower open end. The lower open end removably receives an upper end of a T-type post in order to secure the holder and the attached device to the post.

In order to mount the device to a vehicle, the hollow central pipe can either be modified to receive a ball hitch or can be eliminated and the frame can be directly attached to the vehicle via bolts, welding, or other suitable fastening means.

DETAILED DESCRIPTION OF THE PREFERRED EMBODIMENT

Figures 1, 2:
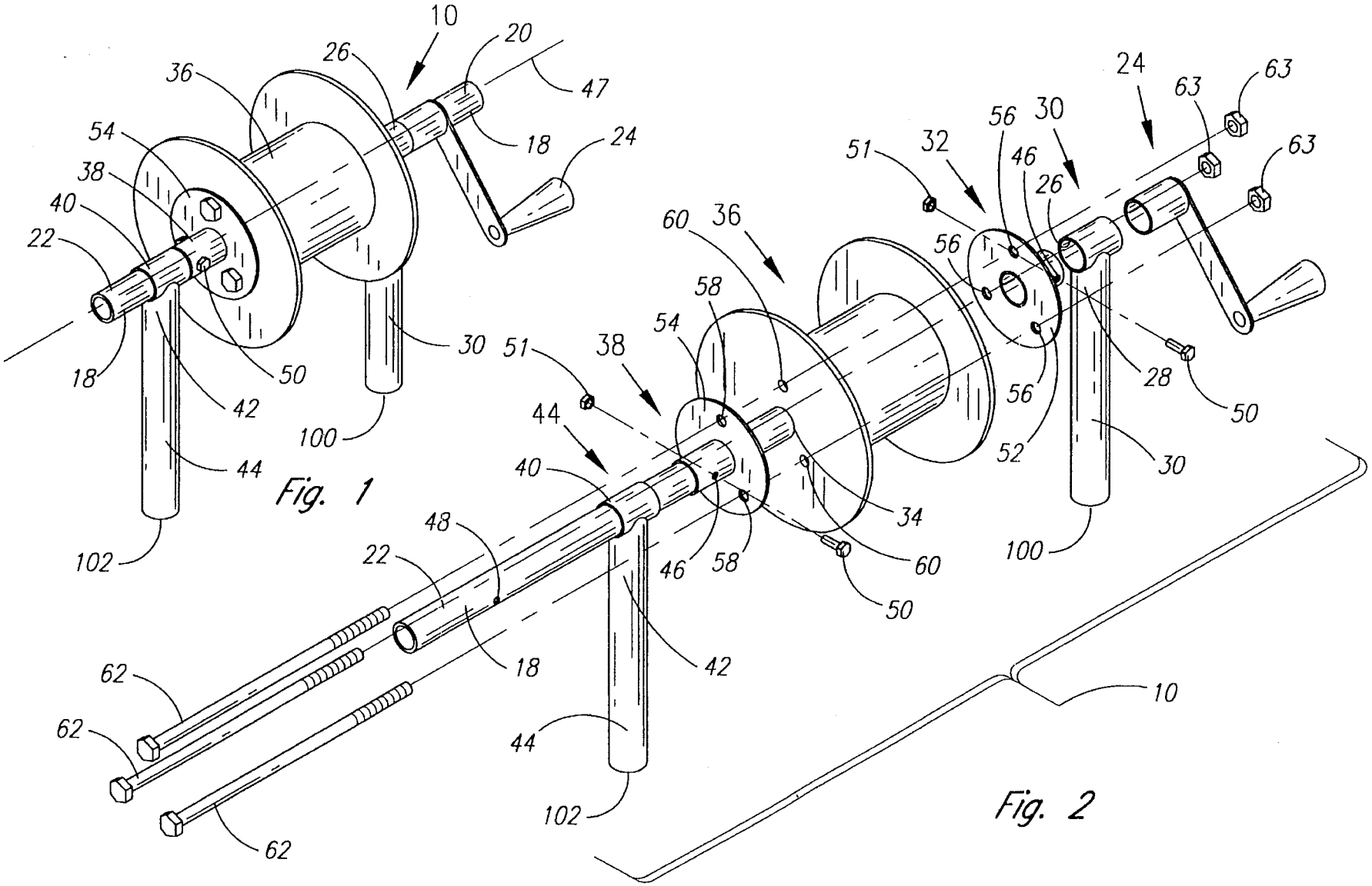
FIG. 1 is a perspective view of a device for rewinding electric fence wire constructed in accordance with a preferred embodiment of the present invention, shown with an empty spool attached thereto.
FIG. 2 is an exploded view of the device of FIG. 1.
Figure 3:
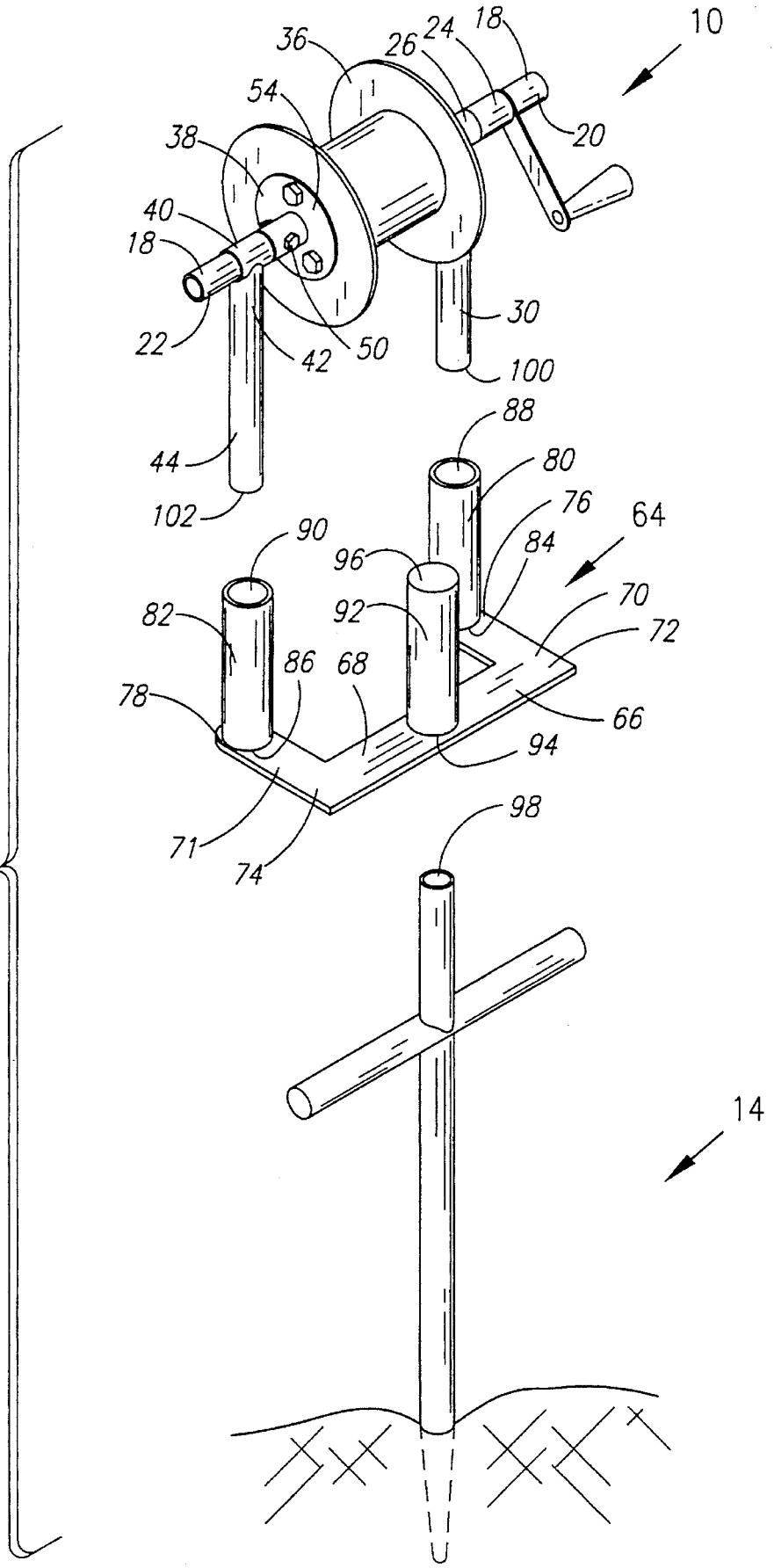
FIG. 3 is a perspective view of the device of FIG. 1 shown with a holder for mounting the device onto a fence post.

Referring to the drawings and initially to FIGS. 1 and 3, there is illustrated a device 10 for rewinding electric fence wire constructed in accordance with a preferred embodiment of the present invention. The device 10 can be mounted either on a T-type post 14 or onto a vehicle (not illustrated), as will be explained in greater detail hereafter.

As shown in FIGS. 1 and 2, the device 10 comprises a horizontal shaft 18 having a first end 20 and an opposite second end 22. The first end 20 is provided with a handle 24 thereon as a means of manually rotating the shaft 18. The handle 24 may either be permanently secured to the first end 20, or alternately, may be removably secured to the first end 20. When the handle 24 is secured to the shaft 18, the shaft 18 will rotate around a longitudinal axis 47 of the shaft 18 whenever the handle 24 is turned. The second end 22 of the shaft 18 inserts consecutively through a first eye 26 provided in one end 28 of a first support member 30, a first bushing 32, a pair of aligned central openings 34 provided in a spool 36, a second bushing 38, and a second eye 40 provided in one end 42 of a second support member 44.

Each of the bushings 32 and 38 is provided with a pair of bushing openings 46 which lie in a plane perpendicular to the longitudinal axis 47 of the shaft 18 and align with an associated pair of shaft holes 48 provided in the shaft 18.

Each bushing 32 and 38 is removably secured to the shaft 18 by a bushing fastener 50, such as a bolt, Kotter pin, or other suitable type of fastener, which inserts through and is removably secured within the aligned bushing openings 46 and shaft holes 48. As shown in FIG. 2, if the bushing fastener 50 is a bolt, a nut 51 engages the bushing fastener 50 to secure it within holes 46 and 48.

Each bushing 32 and 38 is provided with a flange, 52 and 54 respectively. Each flange 52 and 54 is provided with at least one flange opening, 56 and 58 respectively, such that for each flange opening 56, a flange opening 58 is associated therewith so that each pair of associated openings 56 and 58 can be aligned with each other along a plane which is parallel with the longitudinal axis 47 of the shaft 18 by rotating the bushings 32 and 38 on the shaft 18 until the openings 56 and 58 are aligned. Each of the pairs of aligned openings 56 and 58 are associated with a corresponding pair of aligned spool openings 60 provided in the spool 36. By rotating the spool 36, each of the pairs of aligned spool openings 60 can be aligned longitudinally with their associated flange openings 56 and 58 so that the associated openings 56, 58 and 60 lie in a plane parallel with the longitudinal axis 47 of the shaft 18. A spool fastener 62 such as a bolt or other suitable type of fastener, inserts through and is removably secured within each pair of aligned flange openings 56 and 58 and their corresponding pair of aligned spool openings 60 as a means of securing the spool 36 to the bushings 32 and 38. As shown in FIG. 2, if the spool fastener 62 is a bolt, a nut 63 engages the spool fastener 62 to secure it within associated openings 56, 58, and 60.

Thus, because the spool 36 is secured to the bushings 32 and 38 via the spool fasteners 62, and the bushings 32 and 38 are in turn secured to the shaft 18 via the bushing fasteners 50, whenever the handle 24 is employed to rotate the shaft 18 within the stationary first and second eyes 26 and 40, the spool 36 also rotates.

Referring now to FIG. 3, there is illustrated a holder 64 for mounting the device 10 onto the T-type post 14. The holder 64 is provided with a frame 66 comprised of a straight central portion 68. Legs 70 and 71 are provided respectively one on each end 72 and 74 of the central portion 68. The legs 70 and 71 each extend upward at right angles from the frame 66. A distal end 76 and 78 of legs 70 and 71 are provided respectively with hollow end pipes 80 and 82 which extend upward approximately perpendicularly from the frame 66. Each end pipe, 80 and 82, is closed on its lower end, 84 and 86 respectively, and is open on its upper end, 88 and 90 respectively. The frame 66 is provided with a hollow central pipe 92 secured to the central portion 68 approximately midway between the ends 72 and 74. The central pipe 92 extends upward approximately perpendicularly from the frame 66 and approximately parallel with the end pipes 80 and 82. The central pipe 92 is open on its lower end 94 and is closed on its upper end 96 so that it can receive therein an upper end 98 of T-type post 14.

The open upper ends 88 and 90 of pipes 80 and 82 can either receive therein second ends 100 and 102 of support members 30 and 44, as a means of supporting the device 10, or alternately, the open upper ends 88 and 90 can be received within hollow second ends 100 and 102 of respectively the first and second support members 30 and 44.

Although not illustrated, the holder 64 can be modified for use in mounting the device 10 to a vehicle (not shown). The holder 64 can be modified by replacing the central pipe 92 with a female half of a ball hitch so that the holder 64 can be secured to a ball type hitch provided on the vehicle. Alternately, the central pipe 92 can be eliminated entirely and the holder 64 can be attached directly by its frame 66 onto a vehicle by any suitable fastening means such as weld, bolt, screws, etc.

Although one method of supporting the device 10 has been described, it is manifest that other methods of support are encompassed within the scope of the invention, including other methods of supporting the device 10 above the ground and methods for supporting the device 10 on a vehicle, such as a pickup truck or a tractor.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A device for rewinding electric fence wire onto a spool comprising:

a shaft, a handle securing to a first end of said shaft, said shaft rotatably extending through a first eye provided on one end of a first support member, said first eye being adjacent to said handle, said shaft extending through a first bushing removably secured to said shaft, said first bushing being adjacent to said first support member, said shaft removably extending through a pair of central openings provided in a spool, said spool being adjacent to said first bushing, said shaft extending through a second bushing removably secured to said shaft, said second bushing being adjacent to said spool, said shaft extending through a second eye provided on one end of a second support member, said second eye being adjacent said second bushing, said spool removably securing to the first and second bushings so that the spool rotates whenever the shaft is turned by the handle, a flange provided on each of the first and second bushings, said flanges abutting the spool, each flange being provided with flange openings which align longitudinally with associated flange openings provided on the other flange, pairs of aligned spool openings being provided on said spool so that each of the pairs of aligned spool openings also align with an associated flange opening in each flange, a spool fastener removably extending through each pair of aligned spool openings and the associated flange openings in order to removably secure said spool to said bushings.

2. A device according to claim 1 further comprising:

each bushing being provided with a pair of bushing openings which align with a shaft hole provided in the shaft, each said pair of bushing openings and associated shaft hole aligning along a plane approximately perpendicular to a longitudinal axis of the shaft, a bushing fastener inserting through each pair of bushing openings and associated shaft hole in order to removably secure said bushings to said shaft.

3. A device according to claim 1 further comprising:

a holder for securing the device to a vehicle.

4. A device according to claim 1 further comprising:

a holder for securing the device to a post.

5. A device for rewinding electric fence wire onto a spool comprising:

a shaft, a handle securing to a first end of said shaft, said shaft rotatably extending through a first eye provided on one end of a first support member, said first eye being adjacent to said handle, said shaft extending through a first bushing removably secured to said shaft, said first bushing being adjacent to said first support member, said shaft removably extending through a pair of central openings provided in a spool, said spool being adjacent to said first bushing, said shaft extending through a second bushing removably secured to said shaft, said second bushing being adjacent to said spool, said shaft extending through a second eye provided on one end of a second support member, said second eye being adjacent said second bushing, said spool removably securing to the first and second bushings so that the spool rotates whenever the shaft is turned by the handle, and a holder for securing the device to a post further comprising a "U" shaped horizontal frame having a horizontal central portion and a horizontal leg extending outward from each end of the central portion, said legs being approximately parallel with each other, a hollow end pipe securing to a distal end of each leg and extending upward approximately perpendicularly therefrom, each said hollow end pipe having a closed lower end and having an opposite open upper end for engaging second ends of the support members in order to removably secure said device to said holder, a hollow central pipe securing to the central portion approximately midway between the ends of the central portion and extending upward approximately perpendicularly therefrom, said central pipe having a closed upper end and having an open lower end for engaging a post in order to removably secure said holder to said post.

6. A device for rewinding wire onto a spool comprising:

a rotatable shaft having a first end and an opposite second end, a handle attached to said first end for rotating said shaft along its longitudinal axis, said shaft inserting through central openings provided in a spool, a bushing provided on the shaft on each side of the spool, each said bushing being removably secured to the shaft, said spool being removably secured to the bushings, said shaft rotatably inserting through a first eye provided on one end of a first support member and rotatably inserting through a second eye provided on one end of a second support member so that one bushing lies between the spool and the first eye and the other bushing lies between the spool and the second eye, a flange provided on each said bushing so that each flange abuts the spool, each flange being provided with at least one flange opening which aligns along a plane parallel to the longitudinal axis of the shaft with an associated flange opening in the other flange and also aligns with a pair of aligned spool openings provided in the spool, and spool fastening means insertable through each aligned pair of spool openings and associated flange openings in order to removably secure said spool to said bushings.

7. A device according to claim 6 wherein the spool fastening means comprises a bolt secured to the device by a nut which removably engages the bolt.

8. A device according to claim 6 further comprising:

each bushing being provided with a pair of bushing openings aligned along a plane approximately perpendicular to the longitudinal axis of the shaft a shaft hole provided in the shaft in alignment with each pair of bushing openings, and bushing fastening means insertable through each pair of bushing openings and aligned shaft hole in order to removably secure said bushings to said shaft.

9. A device according to claim 8 wherein the bushing fastening means comprises a bolt secured to the device by a nut which removably engages the bolt.

* * * * *